US010665185B2

(12) United States Patent
Tseng et al.

(10) Patent No.: US 10,665,185 B2
(45) Date of Patent: May 26, 2020

(54) DRIVE CIRCUIT AND PICTURE BLACK INSERTION METHOD OF DISPLAY DEVICE

(71) Applicant: ASUSTeK COMPUTER INC., Taipei (TW)

(72) Inventors: Chin-An Tseng, Taipei (TW); Yi-Ching Chen, Taipei (TW); Mien-Mien Cheng, Taipei (TW); Chia-Lei Yu, Taipei (TW); Yung-Ming Huang, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 0 days.

(21) Appl. No.: 16/105,033

(22) Filed: Aug. 20, 2018

(65) Prior Publication Data

US 2019/0066611 A1 Feb. 28, 2019

(30) Foreign Application Priority Data

Aug. 25, 2017 (TW) ..... 106129043 A

(51) Int. Cl.
*G09G 3/36* (2006.01)
*G09G 3/34* (2006.01)

(52) U.S. Cl.
CPC ..... *G09G 3/3618* (2013.01); *G09G 3/3406* (2013.01); *G09G 2310/0237* (2013.01); *G09G 2310/0251* (2013.01); *G09G 2310/08* (2013.01); *G09G 2320/0257* (2013.01); *G09G 2320/0261* (2013.01); *G09G 2320/10* (2013.01)

(58) Field of Classification Search
CPC .. G09G 3/32; G09G 3/30; G09G 3/36; G09G 5/00; G06F 3/038
See application file for complete search history.

(56) References Cited

U.S. PATENT DOCUMENTS

| | | | | |
|---|---|---|---|---|
| 8,773,414 | B2 | 7/2014 | Lin et al. | |
| 9,699,435 | B2 | 7/2017 | Yang et al. | |
| 9,898,966 | B2 | 2/2018 | Xu et al. | |
| 2008/0238897 | A1* | 10/2008 | Kimura | G09G 3/3614 345/204 |
| 2015/0138257 | A1* | 5/2015 | Imai | G09G 3/3208 345/691 |
| 2016/0027383 | A1* | 1/2016 | Yamakawa | G09G 3/342 348/725 |
| 2018/0103231 | A1* | 4/2018 | Ahn | G09G 5/005 |
| 2018/0174551 | A1* | 6/2018 | Ansari | G09G 5/006 |
| 2019/0088192 | A1* | 3/2019 | Xue | G09G 3/20 |

FOREIGN PATENT DOCUMENTS

| | | |
|---|---|---|
| CN | 103413537 B | 10/2015 |
| CN | 105225627 A | 1/2016 |
| TW | 201316823 A1 | 4/2013 |

* cited by examiner

*Primary Examiner* — Pegeman Karimi
(74) *Attorney, Agent, or Firm* — McClure, Qualey & Rodack, LLP

(57) ABSTRACT

A drive circuit for driving a display panel includes a dynamic refresh unit, a timer, and a black insertion drive unit. The dynamic refresh unit is configured to output a dynamic refresh signal, so as to control the display panel to display a plurality of frames in sequence. A frame time of each of the frames is adjusted according to the dynamic refresh signal. The timer is configured to compute a black insertion time signal. The black insertion drive unit is configured to output a black insertion drive signal according to the black insertion time signal, so as to perform black insertion on the frames.

3 Claims, 6 Drawing Sheets

DRIVE CIRCUIT AND PICTURE BLACK INSERTION METHOD OF DISPLAY DEVICE

CROSS-REFERENCE TO RELATED APPLICATION

This application claims the priority benefit of Taiwan application serial No. 106129043, filed on Aug. 25, 2017. The entirety of the above-mentioned patent application is hereby incorporated by reference herein and made a part of specification.

BACKGROUND OF THE INVENTION

Field of the Invention

The present invention relates to a drive circuit, and in particular, to a drive circuit of a display device.

Description of the Related Art

A hold type display device, such as a Liquid Crystal Display (LCD), featuring with image retention phenomenon when displaying a dynamic frame, with a result that a dynamic image is blurred and indistinct.

To reduce the retention phenomenon, black insertion can be performed on an LCD by inserting a black picture between pictures, so as to simulate the feature of an impulse type display such as a Cathode Ray Tube (CRT) display, so as to reduce motion blurred phenomena caused by a dynamic picture.

BRIEF SUMMARY OF THE INVENTION

According to one aspect of the present invention, a drive circuit is provided. The drive circuit is configured to drive a display panel. The drive circuit includes a dynamic refresh unit, a timer, and a black insertion drive unit. The dynamic refresh unit is configured to output a dynamic refresh signal, so as to control the display panel to display a plurality of frames in sequence. Respective frame time of the frames is adjusted according to the dynamic refresh signal. The timer is configured to compute a black insertion time signal. The black insertion drive unit is configured to a black insertion drive signal according to the black insertion time signal, so as to perform black insertion on the frames.

According to one aspect of the present invention, a picture black insertion method of a display device is provided. The picture black insertion method of a display device includes: outputting a dynamic refresh signal via a dynamic refresh unit in a drive circuit, so as to dynamically control the frame time of each of a plurality of frames displayed on the display device; computing a black insertion time signal via a timer in the drive circuit according to the frame time of a previous frame of the display device; and outputting a black insertion drive signal via a black insertion drive unit in the drive circuit according to the black insertion time signal, so as to perform black insertion on the frames.

DETAILED DESCRIPTION OF THE EMBODIMENTS

When an element is "connected" or "coupled" herein, it means that the element is "electrically connected" or "electrically coupled". "Connecting" or "coupling" means that two or more elements operate or interact cooperatively. Furthermore, although terms such as "the first" and "the second" are used to describe different elements herein, the terms are only intended to distinguish elements or operations described with same technical terms. Unless the context clearly indicates, the terms neither indicate or imply a sequence or an order, nor limit the present invention.

Figure 1:
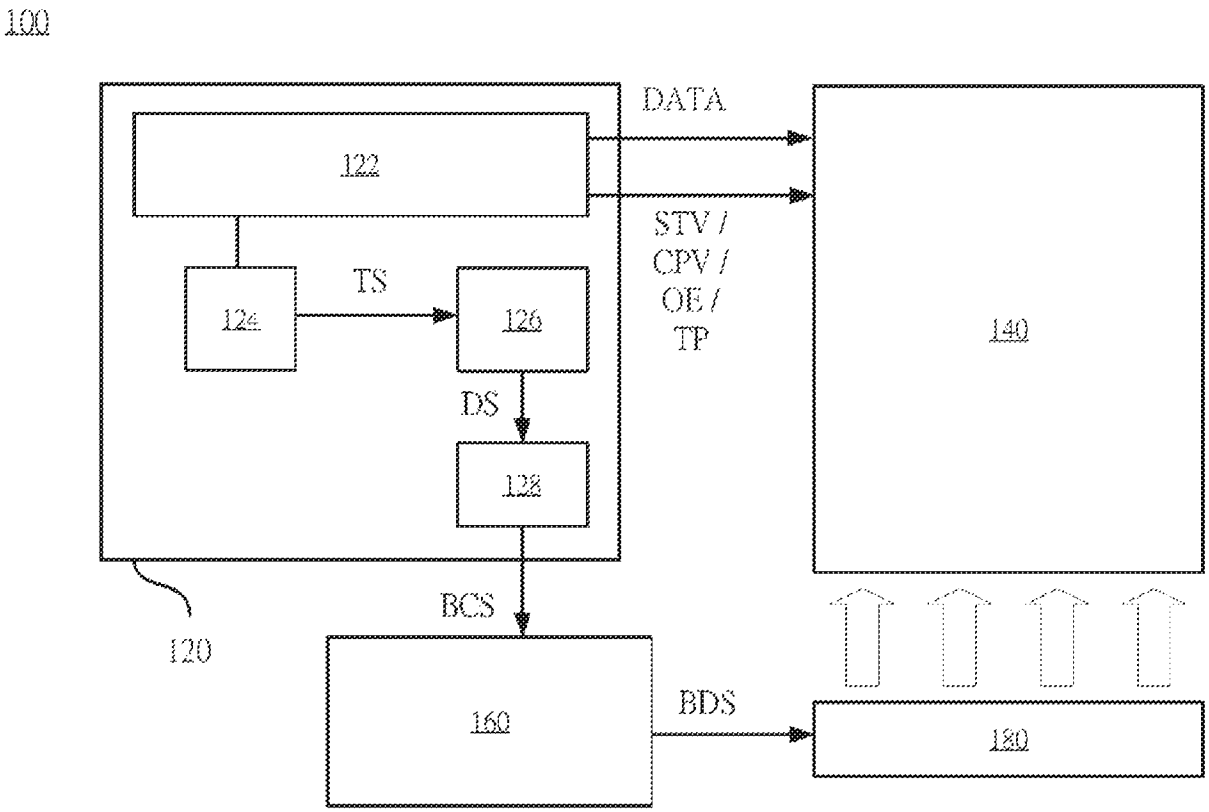
FIG. 1 is a schematic diagram showing a display device according to an embodiment of the present invention.

Referring to FIG. 1, FIG. 1 is a schematic diagram showing a display device 100 according to an embodiment of the present invention. In this embodiment, the display device 100 includes a drive circuit 120, a display panel 140, a backlight controller 160, and a backlight module 180.

The drive circuit 120 is electrically coupled to the display panel 140 and the backlight controller 160. In an embodiment, the display panel 140 is an LCD. The LCD controls a rotation angle of liquid crystal molecules in a display array through providing different electric field intensities, so as to adjust colors and brightness output by each pixel of the display array, and thereby shows an image picture. The backlight controller 160 is electrically coupled to the backlight module 180, so as to output a backlight drive signal (BDS) to control the backlight module 180, so that the backlight module 180 provides a backlight source required by the LCD.

In an embodiment, the drive circuit 120 is implemented by a time controller (TCON) circuit. As shown in FIG. 1, in this embodiment, the drive circuit 120 includes a dynamic refresh unit 122, a timer 124, a black insertion drive unit 126 and a backlight control unit 128.

The dynamic refresh unit 122 is configured to output a dynamic refresh signal to the display panel 140, so as to control the display panel 140 to display a plurality of frames in sequence. In this embodiment, the dynamic refresh signal includes a data signal DATA and control signals STV, CPV, OE, and TP. The control signals STV, CPV, OE, and TP are transmitted to a corresponding gate driver and a corresponding source driver in the display panel 140, so that the display panel 140 controls each display pixel via the gate driver and the source driver. Therefore, the display panel 140 outputs an output image corresponding to each frame according to the data signal DATA.

In this embodiment, the frame time of each frame is not maintained to be a constant, and is dynamically adjusted according to a time length required by rendering of a Graphics Processing Unit (GPU) of the display device 100. When the GPU of the display device 100 finish rendering in a minimum frame time and output information to a video buffer, the display panel 140 refreshes the frame by taking the minimum frame time as a period. Relatively, when the GPU of the display device 100 finish rendering in a minimum frame time, the display panel 140 prolongs the current frame time till the GPU finishes rendering, and the video buffer refreshes a frame after making outputting preparation. In other words, the frame time of each of the frames is adjusted according to the dynamic refresh signal. A picture is refreshed through dynamically adjusting the frame time of each frame, thereby avoiding or reducing sticking or suspending phenomena of pictures.

The timer 124 is electrically coupled to the dynamic refresh unit 122 and is configured to compute a black insertion time signal TS according to the frame time of a previous frame of the display panel 140, and output the black insertion time signal TS to the black insertion drive unit 126.

The black insertion drive unit 126 is electrically coupled to the timer 124, and is configured to output a black insertion drive signal DS to the backlight control unit 128 according to the black insertion time signal TS, so as to perform black insertion on each frame.

The backlight control unit 128 is electrically coupled to the black insertion drive unit 126 and the backlight controller 160, and is configured to receive the black insertion drive signal DS, and output a backlight control signal BCS correspondingly according to the black insertion drive signal DS, so as to control the backlight controller 160, thereby selectively outputting or turning off the backlight source of the display panel 140. As shown in FIG. 1, the backlight source of the display panel 140 is provided by the backlight module 180.

When the display device 100 displays a dynamic picture, to resolve a dynamic image retention phenomenon in the picture, a black insertion technique is introduced into the display device 100 in an embodiment. A hold type LCD simulates the effect of an impulse type display by performing black insertion for a period of time in each frame, so as to reduce motion blurred phenomena caused by a dynamic picture. The black insertion technique implements black insertion in an LCD through turning off the backlight source of the display panel 140 within a set black insertion time.

Figure 2:
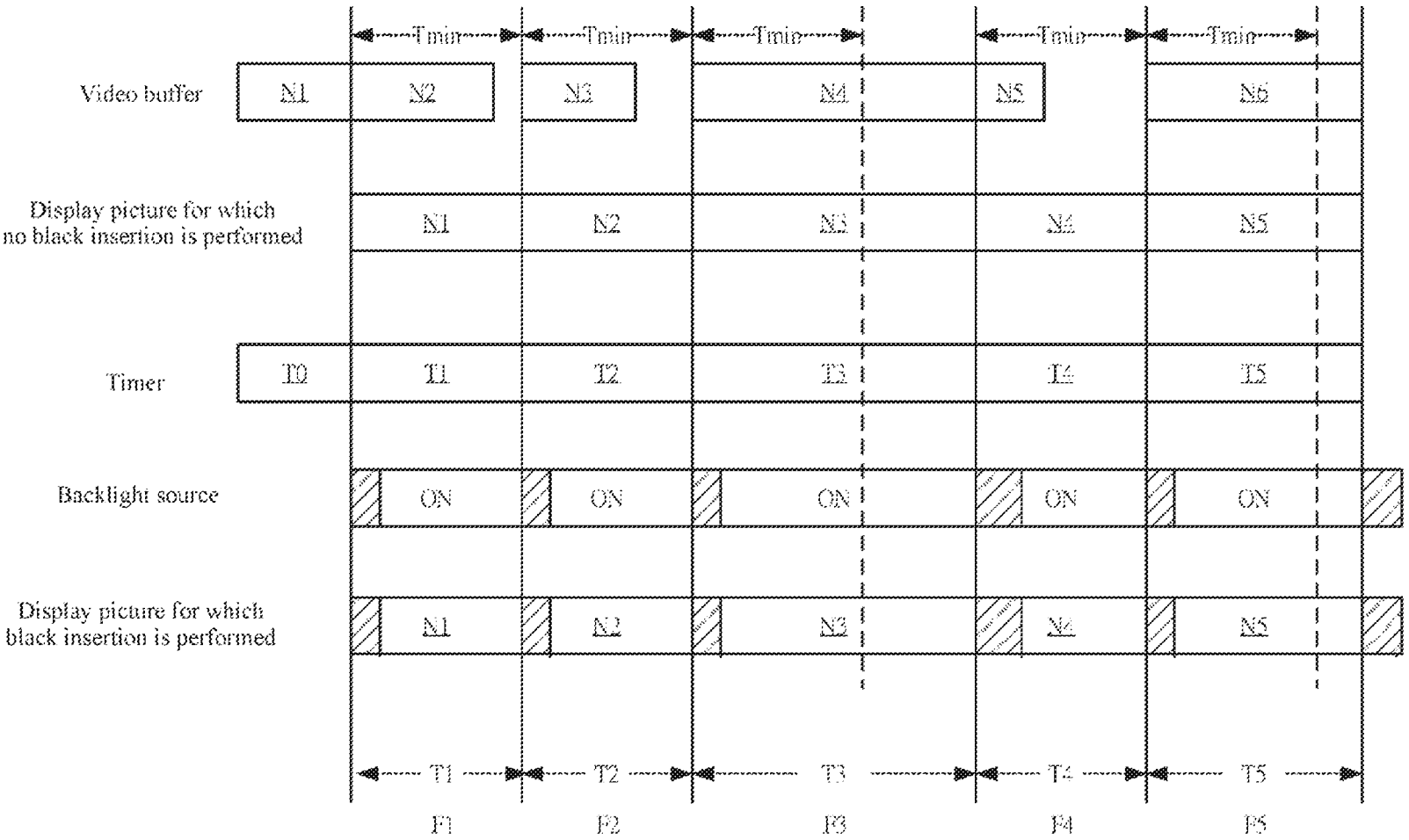
FIG. 2 is a schematic diagram showing a black insertion method according to an embodiment of the present invention.

In an embodiment, the black insertion drive unit 126 outputs a black insertion drive signal DS, so as to dynamically adjust the black insertion time of the display panel 140 in the frame time of a subsequent frame. Referring to FIG. 2, FIG. 2 is a schematic diagram showing a black insertion method according to an embodiment of the present invention. To describe clearly and conveniently, the black insertion method in FIG. 2 is described with reference to the embodiment in FIG. 1, but is not limited thereby.

As shown in FIG. 2, in an embodiment, the complication of rendering is different in each frame time, the video buffer needs different time to process picture information N1-N5 required by each of the frames F1-F5. When the video buffer finish processing the picture information N1-N5 required by a subsequent frame within a minimum frame time Tmin, the dynamic refresh unit 122 outputs a dynamic refresh signal, and takes the minimum frame time Tmin as a period to refresh a picture. As shown in the frames F1, F2, and F4 in FIG. 2, the picture information N2, N3, and N5 required by the subsequent frames have been processed before picture refreshing.

In an embodiment, when the video buffer dose not finish processing the picture information N1-N5 required by the subsequent frames within the minimum frame time Tmin, the dynamic refresh unit 122 waits the video buffer to finish processing and then output the dynamic refresh signal, so as to lengthen the frame time dynamically. As shown in frames F3 and F5 in FIG. 2. The picture information N4 and N6 required by the subsequent frames need long processing time, and therefore, the frame time of the frames F3 and F5 is also prolonged correspondingly. Compared with the picture information N1, N2, and N4, the picture information N3 and the picture information N5 are displayed on the display panel 140 for a longer time.

In this embodiment, the timer 124 computes the frame time T1-T5 of the frames F1-F5 correspondingly, so as to compute the black insertion time signal TS, thereby adjusting a time length for the backlight controller 160 to turn off the backlight source of the display panel 140. As shown in FIG. 2, the time length for turning off the backlight source in a subsequent frame is a fixed percentage (for example, about 20%) of time calculated according to the frame time of the previous frame. In an embodiment, when the frame time T1 is about 16.6 ms, the time length for turning off the backlight source in the frame F2 is about 20% of the frame time T1, that is, about 3.3 ms. When the frame time T3 is prolonged to be about 22.5 ms, the time length for turning off the backlight source in the frame F4 is about 20% of the frame time T3, that is, about 4.5 ms.

After the picture black insertion is performed via the backlight source, as shown in FIG. 2, the frame time T1-T5 of the frames F1-F5 respectively contains first sub-frame time (that is, a diagonal background part) and second sub-frame time (that is, a blank part). The black insertion drive unit 126 controls the display panel 140 to perform black insertion at the first sub-frame time (that is, diagonal background parts) of the frames F1-F5. Thus, a ratio of the first sub-frame time to the corresponding frame time T1-T5 is a constant.

Since the timer 124 of the display device 100 computes black insertion time required by backlight black insertion according to the time for displaying a previous picture, picture brightness output by the display panel 140 is maintained to be a constant.

In view of the above, when the frame time T1-T5 is dynamically adjusted, the picture brightness is maintained unchanged by dynamically adjusting the black insertion time of each of the frames F1-F5, thereby avoiding a flickering phenomenon of a picture caused by a fixed time length of the black insertion of the frames F1-F5.

Figure 3:
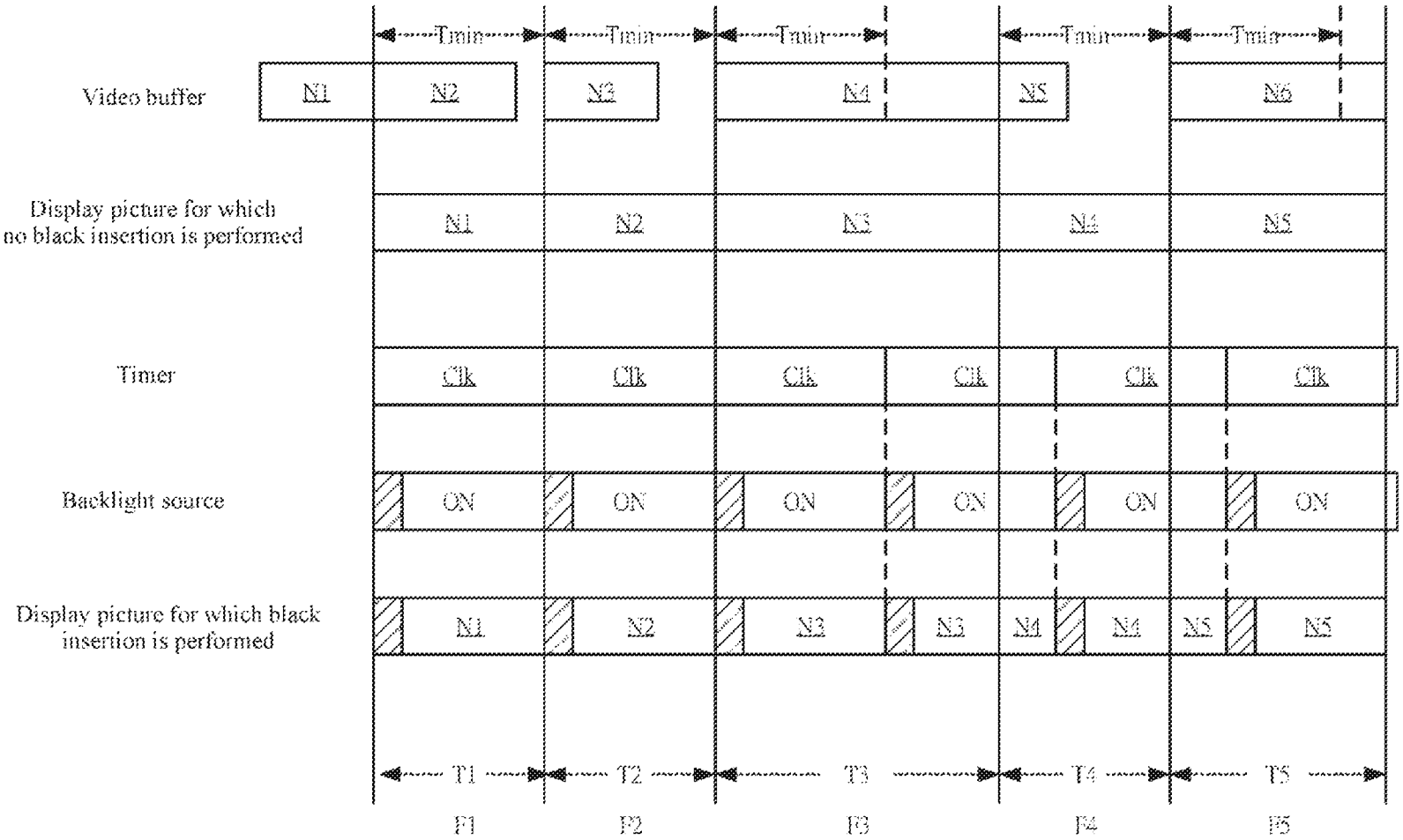
FIG. 3 is a schematic diagram showing a black insertion method according to another embodiment of the present invention.

In another embodiment, the black insertion drive unit 126 outputs a black insertion drive signal DS, so that the display panel 140 performs black insertion at a fixed frequency. Referring to FIG. 3, FIG. 3 is a schematic diagram showing a black insertion method according to another embodiment of the present invention. The black insertion method in FIG. 3 is described with reference to the embodiment in FIG. 1, but is not limited thereby. Compared with the embodiment in FIG. 2, in this embodiment, the timer 124 computes a black insertion time signal TS at a fixed frequency in a fixed period.

As shown in FIG. 3, in this embodiment, the switching time Clk computed by the timer 124 is maintained to be a fixed value, and the time for turning on and off the backlight source is also maintained unchanged, so as to be independent of the frames F1-F5. In an embodiment, the switching time Clk is set as 16.6 ms, including 13.3 ms of backlight ON time (that is, the blank part) and 3.3 ms of backlight OFF time (that is, the diagonal background part), and the time length for turning off the backlight source is about 20%.

In other words, the black insertion drive unit 126 outputs a black insertion drive signal DS according to the black insertion time signal TS, so that the display panel 140 performs black insertion at a fixed frequency, and the time length for turning off the backlight source in each period is a constant. In this way, in the same frame (for example, the frame F3), the backlight source is turned off for more than once. The interval of turning off the backlight source is at any position in the frame, rather than the starting or ending point of the frame.

According to the foregoing black insertion control mode, the frame time and the black insertion time are decoupled, so as to maintain picture brightness unchanged in a situation that the frame time is dynamically adjusted and avoid a flickering phenomenon of a picture.

Figure 4:
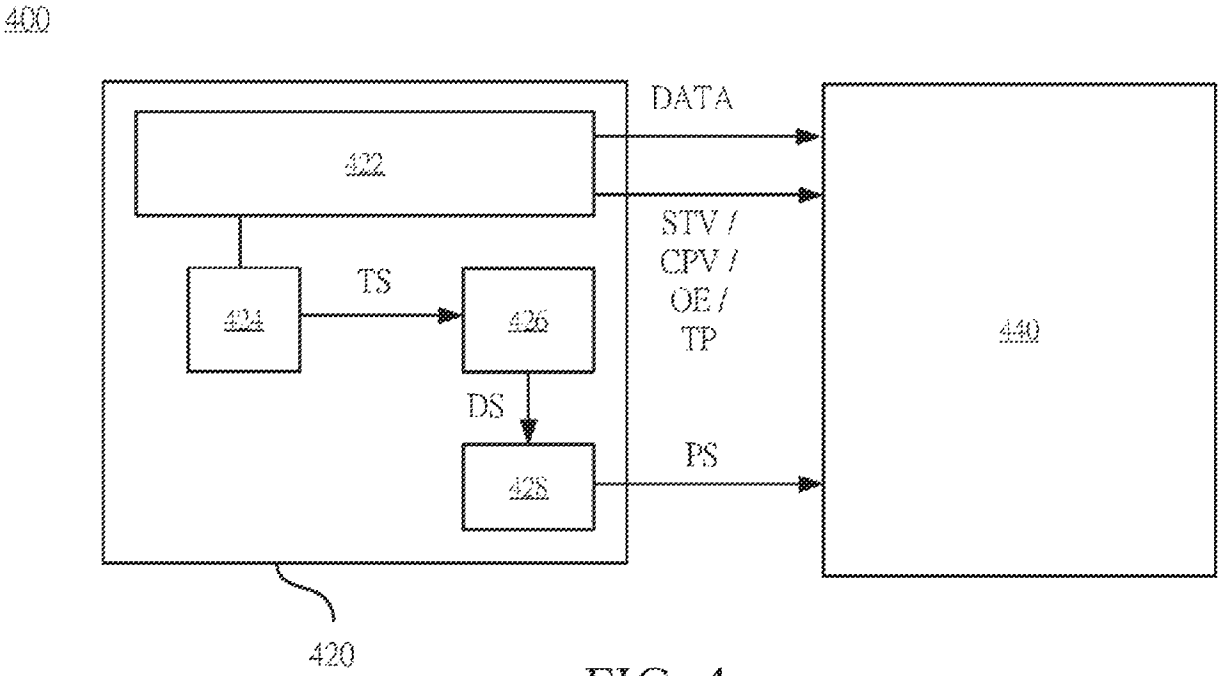
FIG. 4 is a schematic diagram showing a display device according to another embodiment of the present invention.

Referring to FIG. 4, FIG. 4 is a schematic diagram showing a display device 400 according to another embodiment of the present invention. In this embodiment, the display device 400 includes a drive circuit 420 and a display panel 440.

The drive circuit 420 is electrically coupled to the display panel 440. In an embodiment, the display panel 440 is an Organic Light-Emitting Diode (OLED), and an image picture is output via the OLED in the display array.

In this embodiment, compared with the LCD in FIG. 1, each pixel in the display panel 440 emits light by the OLED, and a backlight module does not need to be provided additionally.

The drive circuit 420 in this embodiment is similar to the drive circuit 120, and is implemented by a time controller (TCON). As shown in FIG. 4, in this embodiment, the drive circuit 420 includes a dynamic refresh unit 422, a timer 424, a black insertion drive unit 426, and a signal control unit 428.

The dynamic refresh unit 422 is configured to output a dynamic refresh signal to the display panel 440, so as to control the display panel 440 to display a plurality of frames in sequence. In this embodiment, the dynamic refresh signal includes a data signal DATA and control signals STV, CPV, OE, and TP. The control signals STV, CPV, OE, and TP is transmitted to a corresponding gate driver and a corresponding source driver in the display panel 440, so that the display panel 440 controls each display pixel via the gate driver and the source driver. Therefore, the display panel 440 outputs an output image corresponding to each frame according to the data signal DATA. In this embodiment, the frame time of each frame is also be adjusted dynamically according to the time length required by of rendering the GPU of the display device 100, and the specific operation is similar to the embodiment in FIG. 1 and will not be repeated herein.

The timer 424 is electrically coupled to the dynamic refresh unit 422, and is configured to compute a black insertion time signal TS according to the frame time of a previous frame of the display panel 440, and output the black insertion time signal TS to the black insertion drive unit 426. The black insertion drive unit 426 is electrically coupled to the timer 424, and is configured to output the black insertion drive signal DS to the signal control unit 428 according to the black insertion time signal TS, so as to dynamically adjust the black insertion time of the display panel 140 in the frame time of the subsequent frame.

The signal control unit 428 is electrically coupled to the black insertion drive unit 426 and the display panel 440. The signal control unit 428 is configured to receive the black insertion drive signal DS, and output a panel signal PS to the display panel 440 correspondingly according to the black insertion drive signal DS. Compared with the display device 100 in FIG. 1, the display device 400 outputs a panel signal PS to the display panel 440, so as to implement black insertion on a picture.

Figure 5:
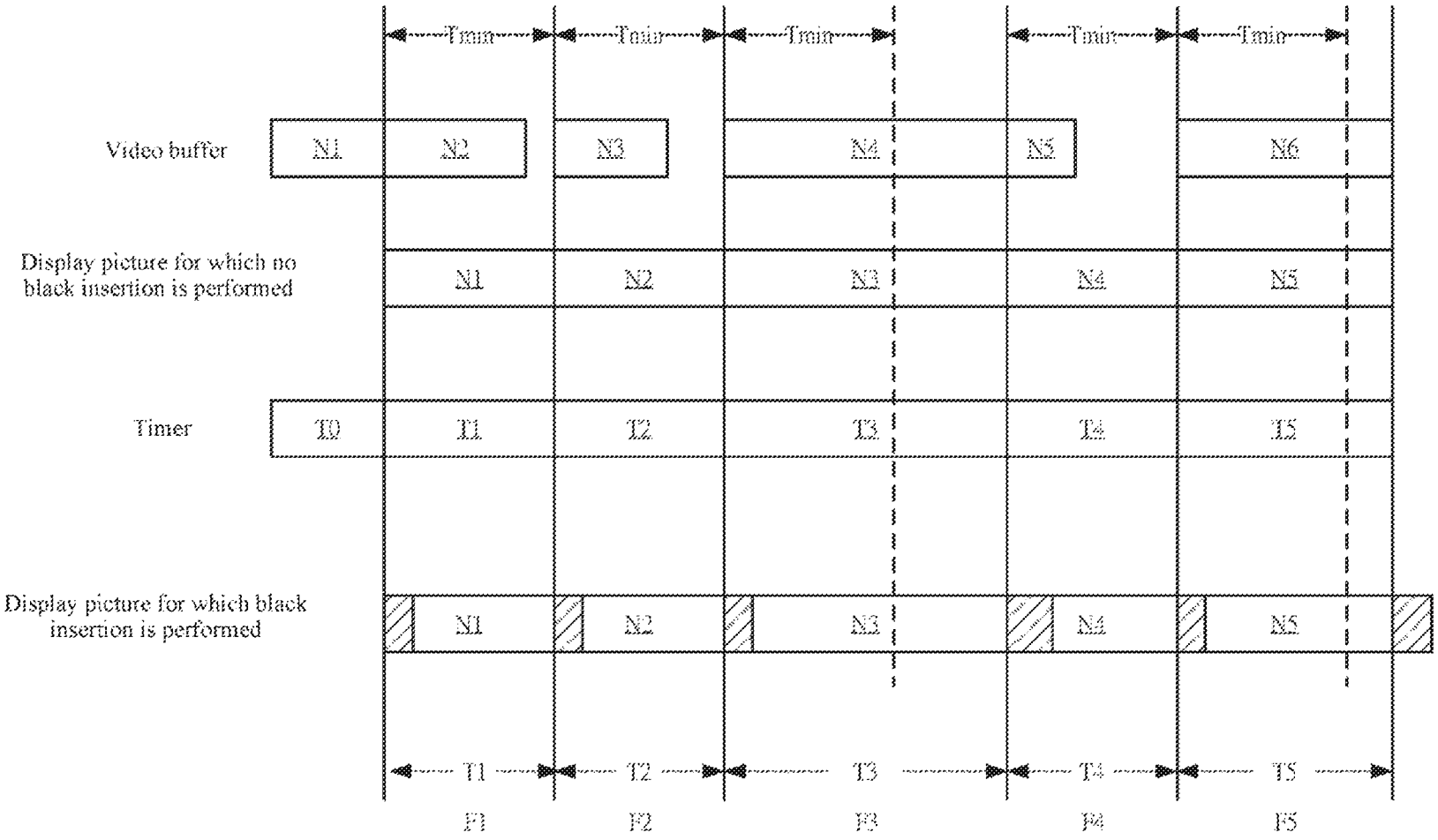
FIG. 5 is a schematic diagram showing a black insertion method according to another embodiment of the present invention.

In an embodiment, the signal control unit 428 outputs a panel signal PS correspondingly to dynamically adjust the black insertion time in the frame time. Referring to FIG. 5, FIG. 5 is a schematic diagram showing a black insertion method according to another embodiment of the present invention. To describe clearly and conveniently, the black insertion method shown in FIG. 5 is described with reference to the embodiment in FIG. 4, but is not limited thereby.

The black insertion method shown in FIG. 5 is similar to the embodiment shown in FIG. 2, and the timer 424 computes the frame time T1-T5 of the frames F1-F5 correspondingly, so as to compute the black insertion time signal TS, thereby adjusting the time length for the panel signal PS to perform black insertion on the display panel 440. This embodiment is similar to the embodiment in FIG. 2. In this embodiment, the time length of the black insertion in the subsequent frame is a fixed percentage (for example, about 20%) of time computed according to the frame time of the previous frame. In this way, the frame time T1-T5 of the frames F1-F5 respectively includes first sub-frame time (that is, diagonal background part) and second sub-frame time (that is, blank part). The black insertion drive unit 426 controls the display panel 440 to perform black insertion in the first sub-frame time (that is, diagonal background parts) of the frames F1-F5. Therefore, a ratio of the first sub-frame time to the corresponding frame time T1-T5 is a constant.

Figure 6:
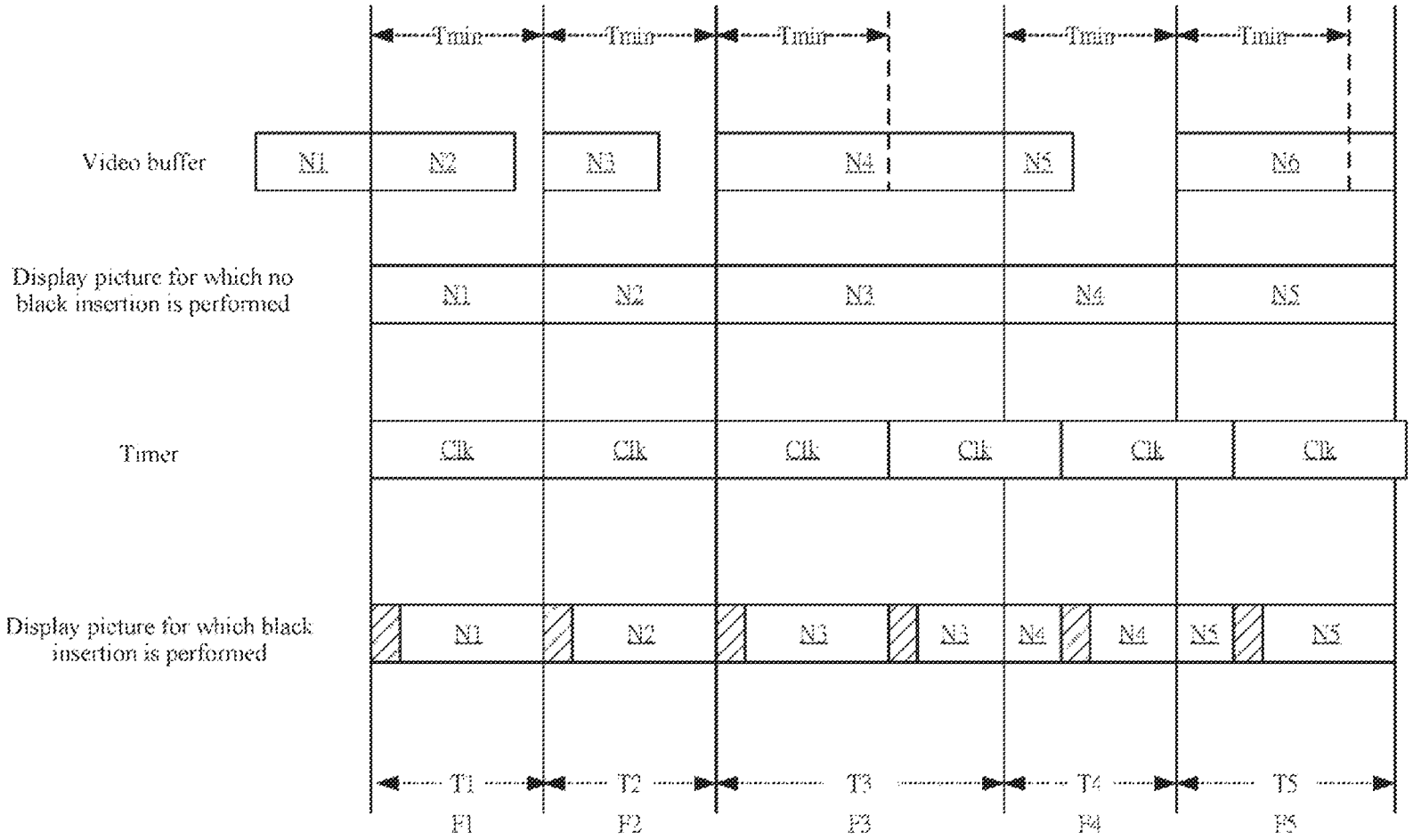
FIG. 6 is a schematic diagram showing a black insertion method according to another embodiment of the present invention.

In another embodiment, the signal control unit 428 outputs a panel signal PS correspondingly, so that the display panel 440 performs black insertion at a fixed frequency. Referring to FIG. 6, FIG. 6 is a schematic diagram showing a black insertion method according to another embodiment of the present invention. The black insertion method shown in FIG. 6 is also described with reference to the embodiment shown in FIG. 4, but is not limited thereby. Compared with the embodiment in FIG. 5, in this embodiment, the timer 424 computes the black insertion time signal TS at a fixed frequency in a fixed period.

As shown in FIG. 6, the switching time Clk computed by the timer 424 in this embodiment is maintained to be a constant, the panel signal PS controls the display panel 440 to maintain the frequency and time length of the black insertion unchanged, so as to be independent the frames F1-F5. In an embodiment, the panel signal PS controls the display panel 440 to output a picture with 80% displayed and 20% implemented with black insertion.

The dynamic refresh units 122 and 422, the timers 124 and 424, the black insertion drive units 126 and 426, the backlight control unit 128, and the signal control unit 428 in the drive circuits 120 and 420 in each embodiment are realized by various types of digital or analog circuits, or are also realized by different integrated circuit chips. Each unit can also be integrated into a single digital control chip. Each control circuit can also be realized by various processors or other integrated circuit chips. The foregoing description is only exemplary and the present invention is not limited thereby.

In view of the above, in each embodiment of the present invention, the black insertion time of each frame is adjusted dynamically or the frame time and the black insertion time are decoupled, so as to maintain picture brightness unchanged in a situation that the frame time is adjusted dynamically and avoid a flickering phenomenon of a picture. Furthermore, in different embodiments, the drive circuit realizes picture black insertion in different driving modes according to the type of the display panel. Although the embodiments of the present invention are disclosed above, the embodiments are not intended to limit the present invention. A person of ordinary skill in the art can make some changes and modifications without departing from the spirit and scope of the present invention. The protection scope of the present invention should depend on the claims.

What is claimed is:

1. A picture black insertion method of a display device, comprising:

outputting a dynamic refresh signal via a dynamic refresh unit of a drive circuit, so as to dynamically control a frame time of each of a plurality of frames displayed on a display device;

computing a black insertion time signal via a timer in the drive circuit according to the frame time of a previous frame of the display device;

outputting a black insertion drive signal via a black insertion drive unit in the drive circuit according to the black insertion time signal, so as to perform black insertion on the frames;

outputting a backlight control signal via a backlight control unit on the display device according to the black insertion drive signal; and controlling a backlight controller in the display device according to the backlight control signal, so as to selectively output or turn off a backlight source and dynamically adjust black insertion time in the frame time of a subsequent frame of the display device, or so as to selectively output or turn off a backlight source, so that the display device performs black insertion at a fixed frequency, and a time for turning off the backlight source in each period is a constant.

2. A picture black insertion method of a display device, comprising:

outputting a dynamic refresh signal via a dynamic refresh unit of a drive circuit, so as to dynamically control a frame time of each of a plurality of frames displayed on a display device;

computing a black insertion time signal via a timer in the drive circuit according to the frame time of a previous frame of the display device;

outputting a black insertion drive signal via a black insertion drive unit in the drive circuit according to the black insertion time signal, so as to perform black insertion on the frames;

outputting a panel signal via a signal control unit in the drive circuit according to the black insertion drive signal; and adjusting black insertion time in the frame time of a subsequent frame of the display device dynamically according to the panel signal.

3. A picture black insertion method of a display device, comprising:

outputting a dynamic refresh signal via a dynamic refresh unit of a drive circuit, so as to dynamically control a frame time of each of a plurality of frames displayed on a display device;

computing a black insertion time signal via a timer in the drive circuit according to the frame time of a previous frame of the display device;

outputting a black insertion drive signal via a black insertion drive unit in the drive circuit according to the black insertion time signal, so as to perform black insertion on the frames; and outputting a panel signal to a display panel of the display device via a signal control unit in the drive circuit according to the black insertion drive signal, so that the display device performs black insertion at a fixed frequency, and a black insertion time for the display device to perform black insertion in each period is a constant.

* * * * *